US005866831A

United States Patent [19]

Kimble

[11] Patent Number: 5,866,831

[45] Date of Patent: Feb. 2, 1999

[54] SIMULATED PIANO ACTION APPARATUS FOR ELECTRONIC KEYBOARD

[75] Inventor: Thomas E. Kimble, Cincinnati, Ohio

[73] Assignee: Baldwin Piano & Organ Company, Inc., Loveland, Ohio

[21] Appl. No.: 969,076

[22] Filed: Nov. 12, 1997

[51] Int. Cl.[6] ..... G10C 3/12

[52] U.S. Cl. ..... 84/439; 84/433; 84/440

[58] Field of Search ..... 84/433, 439, 440

[56] References Cited

U.S. PATENT DOCUMENTS

| | | | |
|---|---|---|---|
| 3,581,254 | 5/1971 | Cannon et al. | 335/255 |
| 4,119,008 | 10/1978 | Kimble . | |
| 4,217,803 | 8/1980 | Dodds . | |
| 4,375,179 | 3/1983 | Schwartz et al. . | |
| 4,953,433 | 9/1990 | Fandrich et al. . | |
| 5,036,743 | 8/1991 | Yamaguchi et al. . | |
| 5,123,321 | 6/1992 | Caught . | |
| 5,239,907 | 8/1993 | Sugiyama et al. . | |
| 5,406,875 | 4/1995 | Tamai et al. . | |
| 5,571,983 | 11/1996 | Yamaguchi et al. . | |

*Primary Examiner*—William M. Shoop, Jr.
*Assistant Examiner*—Shih-Yung Hsieh
*Attorney, Agent, or Firm*—Steven J. Rosen

[57] ABSTRACT

An electronic keyboard key apparatus includes a longitudinally extending key pivotally mounted on a supporting base and a simulated hammer assembly including a simulated hammer mounted on a hammer shank that is independently pivotally mounted with respect to the key on the base. A jack means is mounted on the key for striking and pivoting the hammer assembly when the key is struck and a preferably flexible bridle for controlling the hammer assembly connects the hammer assembly to the key. A spring is connected between a back end of the key and the base for quickly returning the key to its at rest position. The bridle may be a flexible strap. The simulated hammer may be a metallic cylinder disposed about a first distal end of the hammer shank. A butt is attached to a second distal end of the shank and the butt has a butt end that is bifurcated to form two hinge lugs that are hinged to a single hinge lug of a lug mount fixedly connected to the base. The shank and the butt may be constructed as a single integral member and made of wood as can be the lug mount. The simulated hammer assembly may be mounted above the key and the lug mount is mounted above the key on a first rail. A hammer cushioning means for cushioning and resting the simulated hammer is mounted to the base beneath the simulated hammer and a hammer stop is disposed above the hammer cushioning means such that the simulated hammer engages the stop when the key is struck causing the hammer shank to pivot upwards. The hammer stop may be a U-shaped stop cushion with a circularly bent end, legs extending away from the bent end, and the stop cushion mounted to a stop bar by a clamp channel that clamp the legs between the channel and the stop bar.

22 Claims, 2 Drawing Sheets

SIMULATED PIANO ACTION APPARATUS FOR ELECTRONIC KEYBOARD

BACKGROUND OF THE INVENTION

1. Field of the invention

The present invention relates to electronic keyboards having selectively depressed keys designed to simulate piano playing. In particular, the present invention relates to keyboard keys of an electrically operated musical instrument which simulates the feel and action of keyboard keys of a mechanically operated piano.

2. Discussion of the Background Art

Electronic musical instruments frequently use keyboards for determining sounds to be played. Piano-action keyboard provides, in addition to pitch selection, a range of expression generally characterized by a complex function of volume, harmonic structure and envelope which is dependent on the speed and force with which the key is struck. At the same time, a characteristic kinesthetic feedback is provided. The "feel" of a keyboard is a characteristic that is generally of great importance to the player. Various types of electronic keyboard instruments have been developed and disclosed such as in U.S. Pat. No. 4,217,803 which also discloses some of the drawbacks of such instruments that are used to simulate piano-type instruments. One such drawback is that the electronic keyboard lacks of "feel" of mechanical keyboards which is particularly detrimental to a player conditioned by prior training to prefer the piano-action feel. Conventional piano actions are quite complex in nature and their "feel" is determined by the interaction of a large number of moving parts. Careful adjustment of these actions is required during the manufacturing process and this adds to their cost.

Mechanically operated pianos have keys which have a certain feel to the pianist depressing the keys. Towards this end, the present invention provides a piano-action electronic keyboard and key mechanism that provides a realistic piano-like feel and action and kinesthetic feedback to the player simulating the feel and action of the keys on a mechanical piano.

SUMMARY OF THE INVENTION

An electronic keyboard key apparatus includes a longitudinally extending key pivotally mounted on a supporting base and a simulated hammer assembly including a simulated hammer mounted on a hammer shank that is independently pivotally mounted with respect to the key on the base. A jack means is mounted on the key for striking and pivoting the hammer assembly when the key is struck and a bridle for controlling the hammer assembly connects the hammer assembly to the key. The bridle restrains the hammer assembly to limit pivoting of the hammer assembly with respect to the key. The bridle is preferably a flexible strap adjustably connected at a first end to the hammer assembly and at a second end to the key. A return spring may be connected between the key and the base. The simulated hammer may be a metallic cylinder disposed about a first distal end of the hammer shank. A butt is attached to a second distal end of the shank and the butt has a butt end that is bifurcated to form two hinge lugs that are hinged to a single hinge lug of a lug mount fixedly connected to the base. The shank and the butt may be constructed as a single integral member and made of wood as can be the lug mount. The simulated hammer assembly may be mounted above the key and the lug mount is mounted above the key on a first rail. A hammer overtravel stop means for preventing overtravel of the simulated hammer is mounted to the base beneath the simulated hammer and a hammer stop is disposed above the hammer cushioning means such that the simulated hammer engages the hammer stop when the key is struck causing the hammer shank to pivot upwards. The hammer stop may be a U-shaped stop cushion with a circularly bent end, legs extending away from the bent end, and the stop cushion mounted to a stop bar by a clamp channel that clamp the legs between the channel and the stop bar. The apparatus may also include a detecting means for detecting movement of the key.

ADVANTAGES OF THE INVENTION

The present invention has the advantage over conventional electronic keyboards that simulate pianos because it provides a more realistic action and feel to the keys. It provides a more realistic feel for a piano playing technique called "repetition" and a playing technique in which the same tone is to be rapidly and continuously produced for a short period of time in a trill-like manner.

Unlike conventional electronic piano keyboards, the present invention provides a key mechanism that produces the feel and kinematic key action as found on grand pianos.

BRIEF DESCRIPTION OF THE DRAWINGS

The novel features believed characteristic of the present invention are set forth and differentiated in the claims. The invention, together with further objects and advantages thereof, is more particularly described in conjunction with the accompanying drawings in which:

DETAILED DESCRIPTION

Figure 1:
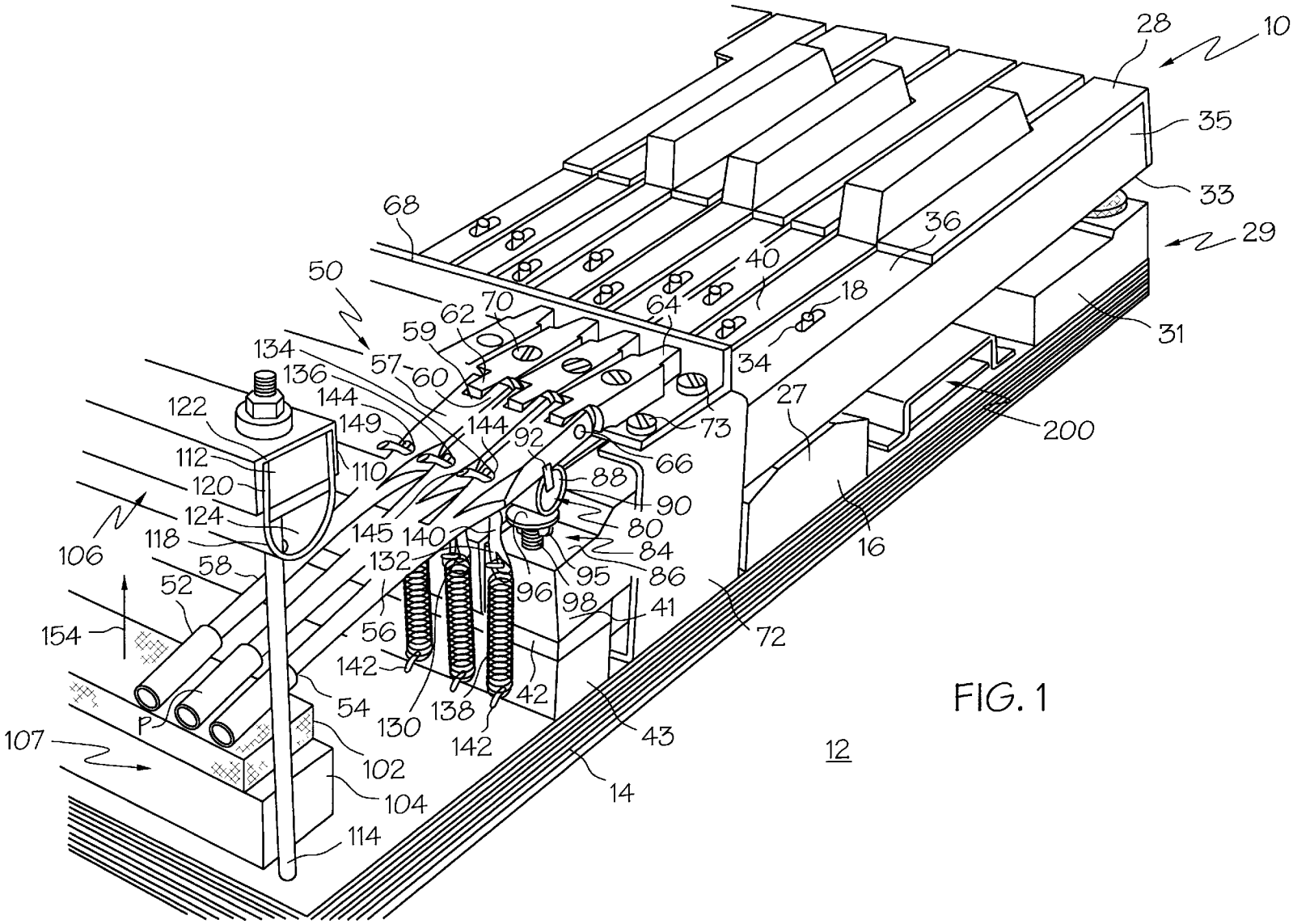
FIG. 1 is a perspective view illustrating a portion of an electronic keyboard in accordance with an exemplary embodiment of the present invention.
Figure 2:
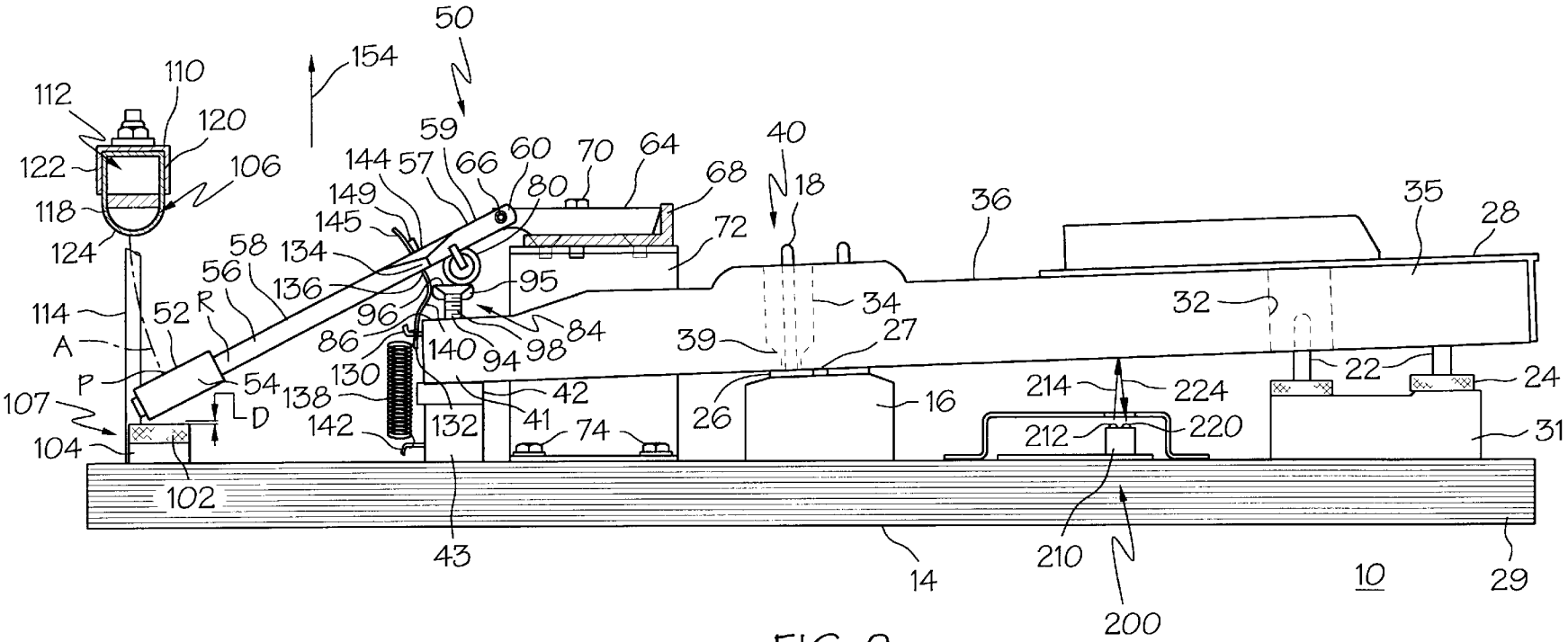
FIG. 2 is a side elevation view in section of an electronic keyboard key apparatus illustrated in FIG. 1.

Referring now to the drawings in detail wherein identical numerals indicate the same elements throughout the figures. FIGS. 1 and 2 illustrate an electronic keyboard key apparatus of the present invention generally shown at 10 incorporated in an electronic piano-type keyboard 12 (shown in part). The keyboard 12 includes a keybed frame 14 which, as shown in more detail in FIG. 2, provides a base for supporting a fulcrum bar 16 from which a pivot pin 18 extends vertically upward from the fulcrum bar. A sound damping felt washer 26 is positioned around the pivot pin 18 and resting on a top surface 27 of the fulcrum bar 16. At a front 29 of the keybed frame 14 is a guide pin 22 that extends vertically upward from a punching bar 31 that is secured to the frame. A damping cushion 24 is positioned around the guide pin 22.

A movable key 28 is illustrated in the preferred embodiment as pivotably mounted with respect to the base or frame 14. The key 28 rests on the felt washer 26 on the fulcrum bar 16 and is held in position by the guide pin 22 and the pivot pin 18. The key 28 is provided with an elongated first slot 32 in its underside 33 at a forward end 35 of the key, and an elongated second slot 34 extending downward from the key top surface 36 at an in-between position 40, between the forward end and a tail end or back end 41, of the key. A hole 39 is provided at the bottom of the second slot 34 and the pivot pin 18 extends upward through the hole and into the slot. The pivot pin's extending through the hole 39 and into the second slot 34 provides the pivoting connection of the key 28 on the fulcrum bar 16 of the keybed frame 14. The guide pin 22 extends upward from the keybed frame 14 into the forward first slot 32. The pivot pin 18 and the guide pin 22 permit the up and down pivoting movement of the forward end 35 and the back end 41 of the key 28 on the fulcrum bar 16 while preventing side-to-side movement of the key 28, thereby maintaining all adjacent keys 28 in the keyboard parallel to each other while permitting the keys to be depressed downward. The back end 41 of the key 28 rests on a key cushioning means such as a key cushion pad 42 mounted on top of a key pedestal bar 43 attached to the keybed frame 14.

The embodiment of the present invention illustrated in FIG. 1 shows the electronic keyboard key apparatus 10 having a simulated hammer assembly 50 that includes a simulated hammer 52 illustrated in its preferred embodiment as a tubular steel weight surrounding and attached to a first distal end 54 of a preferably wooden shank 56. A second distal end 58 of the shank 56 is connected to a butt 57 having a butt end 59 that is bifurcated to form two hinge lugs 60 which are hinged to a single hinge lug 62 of a stationary preferably wooden lug mount 64 by a hinge pin 66. The lug mount 64 is attached to a main action rail 68 by a first screw 70. The main action rail 68 is mounted above the keys 28 to brackets 72 (only one is shown) by second screws 73 and the brackets are mounted to the frame 14 by third screws 74.

A butt extension 80 is mounted beneath and connected to the butt end 59 of the butt 57 to engage a jack 84 mounted on a top side 86 of the key 28 at its back end 41. The exemplary embodiment of the present invention is illustrated as, but not limited in, its construction to the following. The butt extension 80 preferably includes a bushing cloth cylinder 88 covered by a leather layer 90 having a thickness of about 1/16th of an inch in the exemplary embodiment illustrated herein. Conventional bushing cloth is typically a thick wool fabric well known in the art. The bushing cloth cylinder 88 is fixedly bent around a core 92 extending from the butt 57. The jack 84 may be constructed of a screw 94 adjustably screwed into the back end 41 of the key 28. A screw head 96 having a flat circular or disc shape is disposed on top of the screw 94 to enhance engagement of the jack 84 and butt extension 80. The screw 94 includes ears 95 above screw threads 98 for adjusting the depth of the screw in the key 28 and an at rest clearance D between the screw head 96 and the butt extension 80. The back end 41 of the key 28 rests on a key cushioning means such as a key cushion pad 42 mounted on top of a key pedestal bar 43 attached to the keybed frame 14.

A bridle 140 is attached at a key end 132 to the back end 41 of the key 28 by a first bent pin 130 and at a butt end 134 to the simulated hammer assembly 50 at a first location 136 that is preferably at an end of the butt 57 near the second distal end 58 of the shank 56. The bridle 140 pivotally restrains the simulated hammer 52, shank 56, and butt 57 at an angle with respect to hinge pin 66 and the key 28. The bridle 140 preferably is a strap made of a non-elastic flexible material. The bridle 140 is connected to the butt 57 at a first strap end 145 which is slidably disposed through an aperture 144 in the butt. The first strap end 145 is secured tightly in the aperture by a removable tapered peg 149. The peg 149 may be removed and inserted in the aperture to secure the strap end 145 so that the bridle 140 may be freely slid through the aperture 144 to adjust the length of the bridle between the key 28 and the hammer assembly 50 and degree of pivoting between the hammer assembly and the key.

The simulated hammer 52 while at rest is pivotally suspended or stopped by the butt extension 80 of the butt 57 contacting and resting on the jack 84 so that the simulated hammer is suspended between a hammer overtravel stop 107 and a hammer stop 106. The hammer stop 106 prevents overtravel of the simulated hammer 52 in the upwards direction and also helps to absorb the kinetic energy of hammer after it is propelled upwards by striking the key 28. The hammer overtravel stop 107, illustrated as a hammer cushion pad 102 mounted on top of a hammer pedestal bar 104 attached to the keybed frame 14, is for preventing overtravel of the simulated hammer in the downward direction due to gravity and rebound off of the hammer stop. At rest the simulated hammer 52 is suspended a clearance D above the cushion pad 102. The stop 106 is preferably constructed as a stop rail 110 having a wooden stop bar 112 supported by metal poles 114 attached to the keybed frame 14. A U-shaped stop cushion 118 having legs 120 is mounted to the wooden stop bar 112 by a metallic clamp channel 122. The U-shaped stop cushion 118 has a preferably circularly bent end 124 and the legs 120 extend away and downward from the bent end. The cushion 118 is preferably made from a felt material that provides a hollow U-shape of the bent end 124 as illustrated in the FIGS. The circularly bent end 124 is positioned to engage the simulated hammer 52 at a point of contact P on the hammer as it travels through an arc A circumscribed by a radius R from a contact point P along the shank 56 to the hinge pin 66. The hollow bent end 124 is slightly springy as well as cushy so as to enhance the kinematic response of the simulated hammer 52 and the shank 56 as well as prevent or dampen any noise that might occur during the playing of the instrument. This feature also enhances the simulated action and feel of a hammer hitting a string in a grand piano.

The bridle 140 serves as a means to control the simulated hammer assembly 50. When the instrument is played, the key 28 is hit and in turn the jack 84 hits the butt 57 causing the simulated hammer assembly 50 to pivot upwards 154 and the simulated hammer 52 to arc through arc A about the hinge pin 66 until the hammer hits the bent end 124 of the U-shaped stop cushion 118. The bridle 140 serves as a control means to constrain the speed and force at which the simulated hammer 52 hits the bent end 124. Preferably, a spring 138 is connected by a second bent pin 142 to the pedestal bar 43 and to a key end 132 to the back end 41 of the key 28 by the first bent pin 130. The spring 138 quickly returns the key to its at rest position with the back end 41 of the key 28 at rest on the key cushion pad 42. The bridle 140 thus enhances the playing action, feel, and kinematics of the electronic keyboard key apparatus 10 and piano simulation of its electronic piano-type keyboard 12. This done with the help of gravity which causes the simulated hammer 52 to return to a rest position over the hammer cushion pad 102 of the hammer cushioning means and the spring 138 which quickly returns the key to its rest position thus further realistically simulating the action and feel of a real grand piano.

An exemplary detecting means 200 for detecting movement of the key 28 is positioned on the frame 14 beneath the key 28 as illustrated in FIGS. 1 and 2. This detecting means 200 is explained in much greater detail in U.S. Pat. No. 5,567,902, issued Oct. 22, 1996, and entitled "METHOD AND APPARATUS FOR OPTICALLY SENSING THE POSITION AND VELOCITY OF PIANO KEYS" which is incorporated herein by reference. As an optoelectronic device 210 having a light emitting diode (LED) 212 is positioned beneath each of the keys and emits light 214 against the underside 33 of each key. A phototransistor 220 is positioned to detect reflected light 224 off of that key.

Other detecting means are well known for detecting position and movement of keys 28 to provide a signal for use by an electrically operated musical instrument and electronic keyboard and some are described in U.S. Pat. No. 5,567,902.

While the preferred embodiment of our invention has been described fully, in order to explain its principles, it is understood that various modifications or alterations may be made to the preferred embodiment without departing from the scope of the invention as set forth in the appended claims.

What is claimed is:

1. An electronic keyboard key apparatus comprising:

a longitudinally extending key pivotally mounted on a supporting base, a simulated hammer assembly including a simulated hammer mounted on a hammer shank that is independently pivotally mounted with respect to said key on said base, a jack means mounted on said key, said jack means for striking and pivoting said hammer assembly when said key is struck, and a bridle for controlling said hammer assembly, said bridle connecting said hammer assembly to said key.

2. An apparatus as claimed in claim 1 wherein said bridle includes a flexible strap.

3. An apparatus as claimed in claim 2 further comprising a spring connecting said key in spring return relationship to said base.

4. An apparatus as claimed in claim 3 wherein said flexible strap and said spring are attached to a back end of said key.

5. An apparatus as claimed in claim 4 wherein said simulated hammer is a metallic cylinder disposed about a first distal end of said hammer shank.

6. An apparatus as claimed in claim 5 wherein a butt is attached to a second distal end of said hammer shank and said butt has a butt end that is bifurcated to form two hinge lugs that are hinged to a single hinge lug of a lug mount fixedly connected to said base.

7. An apparatus as claimed in claim 6, further comprising;

said hammer shank and said butt comprising a single integral member made of wood, said lug mount made of wood, said simulated hammer assembly mounted above said key, and said lug mount mounted above said key on a first rail.

8. An apparatus as claimed in claim 7 further comprising said jack means having a screw adjustably screwed into said key.

9. An apparatus as claimed in claim 8 further comprising said screw having a flat screw head.

10. An apparatus as claimed in claim 1 wherein said simulated hammer is a metallic cylinder disposed about a first distal end of said hammer shank.

11. An apparatus as claimed in claim 10 wherein a butt is attached to a second distal end of said hammer shank and said butt has a butt end that is bifurcated to form two hinge lugs that are hinged to a single hinge lug of a lug mount fixedly connected to said base.

12. An apparatus as claimed in claim 11, further comprising said hammer shank and said butt comprising a single integral member made of wood and said lug mount is made of wood.

13. An apparatus as claimed in claim 11 wherein said simulated hammer assembly is mounted above said key and said lug mount is mounted above said key on a first rail.

14. An apparatus as claimed in claim 13 further comprising a hammer cushioning means for cushioning and resting said simulated hammer, said hammer cushioning means mounted to said base beneath said simulated hammer.

15. An apparatus as claimed in claim 14 further comprising a hammer stop disposed above said hammer cushioning means such that said simulated hammer engages said stop when said key is struck causing said hammer shank to pivot upwards.

16. An apparatus as claimed in claim 15 wherein said hammer stop comprises a U-shaped stop cushion.

17. An apparatus as claimed in claim 16 further comprising said U-shaped stop cushion having a circularly bent end, legs extending away from said bent end, and said stop cushion mounted to a stop bar by a clamp channel clamping said legs between said channel and said stop bar.

18. An apparatus as claimed in claim 17 further comprising a detecting means for detecting movement of said key.

19. An apparatus as claimed in claim 18 further comprising a hammer cushioning means for cushioning and resting said simulated hammer, said hammer cushioning means mounted to said base beneath said simulated hammer and a hammer stop disposed above said hammer cushioning means such that said simulated hammer engages said stop when said key is struck causing said hammer shank to pivot upwards.

20. An apparatus as claimed in claim 19 wherein said hammer stop comprises a U-shaped stop cushion.

21. An apparatus as claimed in claim 20 further comprising said U-shaped stop cushion having a circularly bent end, legs extending away from said bent end, and said stop cushion mounted to a stop bar by a clamp channel clamping said legs between said channel and said stop bar.

22. An apparatus as claimed in claim 21 further comprising a detecting means for detecting movement of said key.

* * * * *